US005574540A

United States Patent [19]

Folkins

[11] Patent Number: 5,574,540

[45] Date of Patent: Nov. 12, 1996

[54] DUAL USE CHARGING DEVICES

[75] Inventor: Jeffrey J. Folkins, Rochester, N.Y.

[73] Assignee: Xerox Corporation, Stamford, Conn.

[21] Appl. No.: 477,013

[22] Filed: Jun. 7, 1995

[51] Int. Cl.[6] ..... G03G 15/01; G03G 15/02

[52] U.S. Cl. ..... 399/171; 399/296; 399/311

[58] Field of Search ..... 355/221, 327, 355/219

[56] References Cited

U.S. PATENT DOCUMENTS

| | | | |
|---|---|---|---|
| 3,392,667 | 7/1968 | Cassel et al. | 101/170 |
| 3,399,611 | 5/1986 | Lusher | 95/1.7 |
| 3,955,530 | 5/1976 | Knechtel | 118/60 |
| 3,957,367 | 5/1976 | Goel | 355/4 |
| 4,141,648 | 2/1979 | Gaitten et al. | 355/14 |
| 4,348,098 | 9/1982 | Koizumi | 355/3 TR |
| 4,515,460 | 5/1985 | Knechtel | 355/3 TR |
| 4,588,279 | 5/1986 | Fukuchi et al. | 355/3 TR |
| 4,935,788 | 6/1990 | Fantuzzo et al. | 355/326 |
| 5,254,424 | 10/1993 | Felder | 430/112 |
| 5,352,558 | 10/1994 | Simms et al. | 430/125 |
| 5,355,201 | 10/1994 | Hwang | 355/256 |

*Primary Examiner*—Arthur T. Grimley
*Assistant Examiner*—Quana Grainger

[57] ABSTRACT

Charging devices which are used for charging and transfer and for charging and pretransfer in color electrophotographic printing. A charging device is used for charging a photoreceptor in preparation for exposure and also for pretransfer charging of a composite color image to ensure that all toner particles have the correct polarity. A subsequent charging device is used for charging the photoreceptor and for transferring a composite color image onto a substrate.

3 Claims, 2 Drawing Sheets

DUAL USE CHARGING DEVICES

FIELD OF THE INVENTION

This invention relates to the art of electrophotographic printing.

BACKGROUND OF THE INVENTION

Electrophotographic marking is a well known and commonly used method of copying or printing original documents. Electrophotographic marking is typically performed by exposing a light image representation of an original document onto a substantially uniformly charged photoreceptor. In response to that light image the photoreceptor discharges so as to create an electrostatic latent image of the original document on the photoreceptor's surface. Toner particles are then deposited onto the latent image so as to form a toner powder image. That toner powder image is then transferred from the photoreceptor, either directly or after an intermediate transfer step, onto a substrate such as a sheet of paper. The transferred toner powder image is then fused to the substrate using heat and/or pressure. The surface of the photoreceptor is then cleaned of residual developing material and recharged in preparation for the creation of another image.

The foregoing generally describes a typical black and white electrophotographic printing machine. Electrophotographic printing can also produce color images by repeating the above process for each color of toner that is used to make the color image. For example, the charged photoconductive surface may be exposed to a light image which represents a first color, say black. The resultant electrostatic latent image can then be developed with black toner particles to produce a black toner image which is subsequently transferred and fused onto a substrate. The process can then be repeated for a second color, say yellow, then for a third color, say magenta, and finally for a fourth color, say cyan. If the toner particles are placed in a superimposed registration the desired composite color image is formed on the substrate. This process is sometimes referred to either as the REaD process (Recharge, Expose, and Develop) or as the IOI process (Image On Image).

While electrophotographic printing has been very successful, the rapid growth of the computer industry has created a tremendous demand for desktop printing machines, particularly color desktop printing machines. Desirable features of desktop color printing machines include high print quality, high speed printing, low cost, and small size. Those desirable characteristics are difficult to achieve simultaneously. One reason for the difficulty of simultaneously achieving all of the desirable characteristics is that color electrophotographic marking requires numerous processing steps which in the prior art were usually performed using a dedicated device to perform each processing step. The use of dedicated devices increased the cost and size of the electrophotographic printing machines.

Multiple uses of individual devices is known in the prior art. For example U.S. Pat. No. 4,141,648 entitled, "Photoconductor Charging Technique" issued to Gaitten et al., on 27 Feb. 1979 teaches a two cycle electrophotographic copying machine wherein one corona device performs both charging and precleaning functions and wherein another corona device performs both precharging and transferring functions. In the "Background of the Invention" of U.S. Pat. No. 4,141,648 is a discussion of prior attempts to combine charging and transferring in one corona generating device.

As discussed, such prior attempts were not entirely successful since the transferring media tended to jam into the grid wires of the corona device and because of nonuniform charge distributions onto the media.

However, color electrophotographic printing involves many more processing steps and is much more sensitive to process variations than electrophotographic black and white printing. Complicating the difficulty of using single devices for multiple uses is the fact that, at least with some color electrophotographic processing techniques, such as image-on-image color processing, charging through developed toner layers and transferring multiple toner layers may be required. The developed toner layers create several problems of interest. First, recharging a photoreceptor to a uniform voltage through an existing toner layer is difficult to do since the presence of toner changes the charge-voltage characteristics of the photoreceptor. Second, toner layers tend to trap charge within their finite thicknesses resulting in an inability to discharge these toned areas to the same electrostatic voltage levels as surrounding non-toned regions. The first problem makes the recharging of a photoreceptor with developed toner layers difficult. The second necessitates the use of special charge neutralizing types of recharging systems and ultimately complicates the transfer of the toner layers onto a substrate and often requires both pretransfer corona and erase treatments. Additionally, REaD Image-on-Image color systems generally utilize Discharge Area Development toner polarity charging whereby the toner is developed in the written image areas and the main charge and toner polarity are equal but are opposite to the transfer polarity. This is as opposed to conventional light lens copying machines which require Charge Area Development and hence equal polarities for the main charge and transfer functions. Because of these problems the method described in U.S. Pat. No. 4,141,648 of making multiple use of charging devices is not compatible with some color printing architectures. Therefore, methods of using individual charging devices for multiple purposes in a color electrophotographic printing machine would be highly desirable.

SUMMARY OF THE INVENTION

The principles of the present invention provide for methods of operating a color electrophotographic printing machine of the type having a photoreceptor, a first charging device, a second charging device, an exposure station, at least two development stations and a substrate handler. According to the principles of the present invention those methods include the steps of forming a first toner layer on the photoreceptor, of using the first charging device to overcharge the photoreceptive surface and the first toner layer to voltages higher than that which they are to have when they are subsequently exposed, of using the second charging device to reduce the voltage levels of the photoreceptive surface and the first toner layer to the level which they are to have when they are subsequently exposed, and of developing at least a second toner layer on the photoreceptor. Those methods further include the steps of using the first charging device to charge the toner layers on the photoreceptor such that the toner layers are of the same polarity as the photoreceptor surface, of locating a substrate over said toner layers, and of using the second charging device to transfer the toner layers onto the substrate.

Multiple use of two charging devices in color electrophotographic printing. A first charging device is used for overcharging a photoreceptor in preparation for exposure and also for pretransfer charging of a composite color image to ensure that all toner particles have the correct polarity. A second charging device is used for reducing the overcharge on the photoreceptor to the correct level and for transferring a composite color image onto a substrate.

BRIEF DESCRIPTION OF THE DRAWINGS

Other aspects of the present invention will become apparent as the following description proceeds and upon reference to.

DETAILED DESCRIPTION OF THE PREFERRED EMBODIMENT

The preferred embodiment of the present invention includes a plurality of individual subsystems which are known in the prior art but which are organized and used so as to produce a color image by making multiple use of individual charging stations. While the preferred embodiment is a 5 cycle color electrophotographic printing machine the present invention is not limited to such machines.

Figure 1:
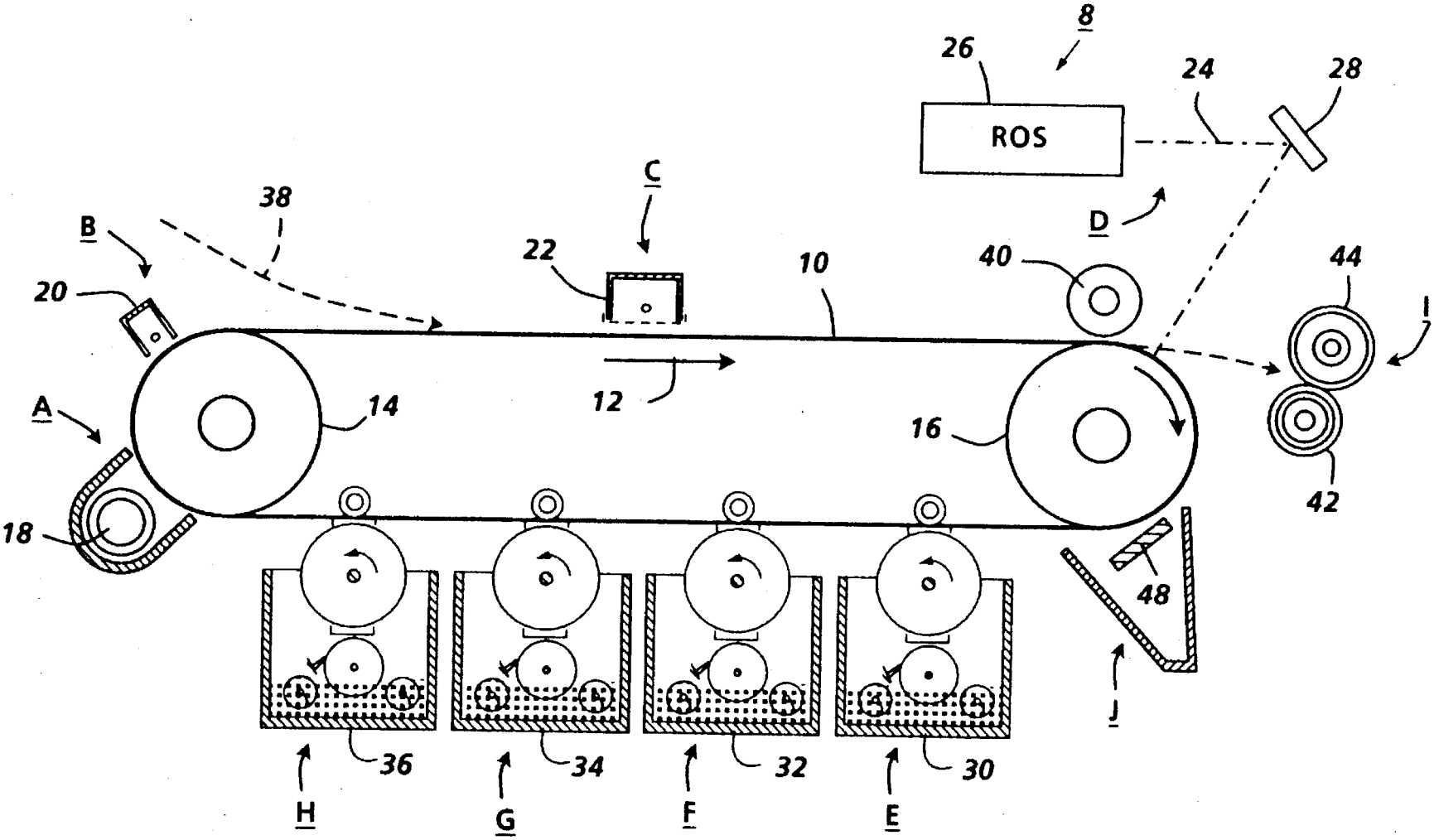
FIG. 1, schematically illustrates a 5 cycle color electrophotographic printing machine suitable for implementing the principles of the present invention.

FIG. 1 illustrates a color electrophotographic printing machine 8 which is suitable for implementing the principles of the present invention. The printing machine 8 includes an Active Matrix (AMAT) photoreceptor belt 10 which travels in the direction indicated by the arrow 12. Belt travel is brought about by mounting the belt about a drive roller 14 (which is driven by a motor which is not shown) and a tension roller 16.

As the photoreceptor belt travels each part of it passes through each of the subsequently described process stations. For convenience, a single section of the photoreceptor belt, referred to as the image area, is identified. The image area is that part of the photoreceptor belt which is to receive the toner images which, after being transferred to a substrate, produce the final color image. While the photoreceptor belt may have numerous image areas, since each image area is processed in the same way a description of the processing of one image area suffices to fully explain the operation of the printing machine.

As previously mentioned, the production of a complete color print takes place in 5 cycles. The first cycle begins with the image area passing through an erase station A. At the erase station an erase lamp 18 illuminates the image area so as to cause any residual charge which exists on the image area to be discharged. Such erase lamps and their use in erase stations are well known. Light emitting diodes are commonly used as erase lamps.

Figure 2A:
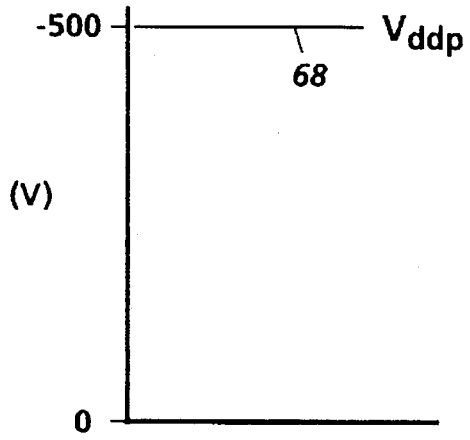
FIG. 2A shows the voltage profile of an image area in the electrophotographic printing machines illustrated in FIG. 1 after that image area has been charged.

As the photoreceptor belt continues its travel the image area passes through a first charging station B. At the first charging station B a first corona generating device 20, beneficially a DC pin corotron, charges the image area to a relatively high and substantially uniform potential of, for example, about −700 volts. After passing the first corona generating device 20 the image area passes through a second charging station C which supplies positive corona that partially discharges the image area to about, for example −500 volts. The second charging station C includes a second charging device 22 which is an AC scorotron. FIG. 2A illustrates a typical voltage profile 68 of an image area after that image area has past through the second charging station C.

The use of a first charging device to overcharge the image area and a subsequent second charging device to neutralize the overcharge is referred to as split charging. A more complete description of split charging may be found in co-pending and commonly assigned U.S. Patent application, "Split Recharge Method and Apparatus for Color Image Formation," Ser. No. 08/347,617 (which is hereby incorporated by reference). Since split charging is beneficial for recharging a photoreceptor which already has a developed toner layer, and since the image area does not have such a toner layer during the first cycle, split charging is not required during the first cycle. If split charging is not used either the first charging device 20 or the second charging device 22 (after readjusting the voltage on the grid) could be used to directly charge the image area to the desired level of −500 volts. Split charging is described in more detail below.

Figure 2B:
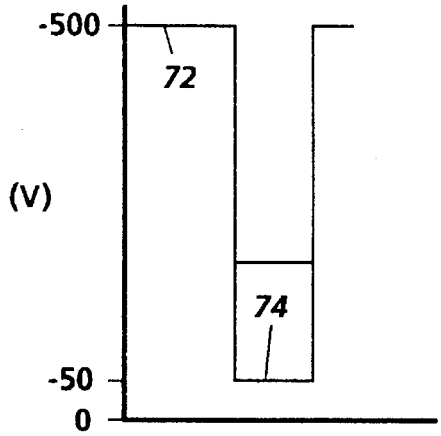
FIG. 2B shows the voltage profile of the image area after being exposed in the first cycle.

After passing through the second charging station C the now charged image area passes through an exposure station D. At the exposure station D the charged image area is exposed to the output 24 of a laser based output scanning device 26 which reflects from a mirror 28. During the first cycle the output 24 illuminates the image area with a light representation of a first color (say black) image. That light representation discharges some parts of the image area so as to create a first electrostatic latent image. For example, illuminated sections of the image area might be discharged by the output 24 to about −50 volts. Thus after exposure the image area has a voltage profile comprised of relatively high voltages of about −500 volts and of relatively low voltages of about −50 volts. FIG. 2B shows the typical voltage levels which might exist on the image area after exposure. The voltage level 72 (about −500 volts) exists on those parts of the image area which were not illuminated, while the voltage level 74 (about −50 volts) exists on those parts which were illuminated. Thus after exposure, the image area has a voltage profile comprised of relative high and low voltages.

Figure 2C:
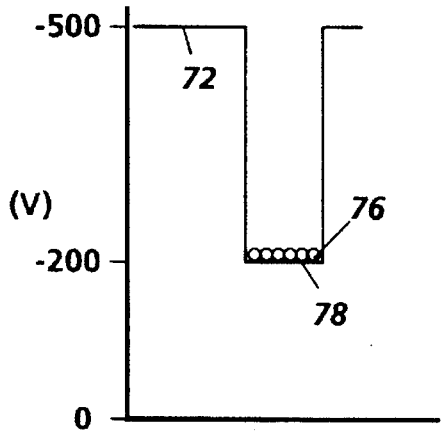
FIG. 2C shows the voltage profile of the image area after being developed in the first cycle.

After passing through the exposure station D the exposed image area passes through a first development station E which deposits a first color of negatively charged toner 30, preferably black, onto the first electrostatic latent image. FIG. 2C shows the voltages on the image area after the image area passes through the first development station E. Toner 76 which adheres to the illuminated image area is charged to a negative voltage. This causes the voltage in the illuminated area to increase to about −200 volts, as represented by the solid line 78. The non-illuminated parts of the image area remain at the level 72. Thus after development the toned parts of the image area are charged to about −200 volts while the untoned parts are charged to about −500 volts.

While the first development station could be a magnetic brush developer, it is preferably a scavengeless developer.

Scavengeless development is well known and is described in U.S. Pat. No. 4,984,019 entitled, "Electrode Wire Cleaning," issued 3 Jan. 1991 to Folkins; in U.S. Pat. No. 4,868,600 entitled "Scavengeless Development Apparatus for Use in Highlight Color Imaging," issued 19 Sep. 1989 to Hayes et al.; in U.S. Pat. No. 5.010,367 entitled "Dual AC Development System for Controlling The Spacing of a Toner Cloud," issued 23 Apr. 1991 to Hays; in U.S. Pat. No. 5,253,016 entitled, "Contaminant Control for Scavengeless Development in a Xerographic Apparatus," issued on 12 Oct. 1993 to Behe et al.; and in U.S. Pat. No. 5,341,197 entitled, "Proper Charging of Doner Roll in Hybrid Development," issued to Folkins et al. on 23 Aug. 1994. Those patents are hereby incorporated by reference.

One benefit of scavengeless development is that it does not disturb previously deposited toner layers. Since in the first cycle the image area does not have a previously developed toner layer, the use of scavengeless development is not required as long as the developer is physically cammed away during other cycles. However, since the other development station (described below) use scavengeless development it may be better to use scavengeless development at each development station.

Figure 2D:
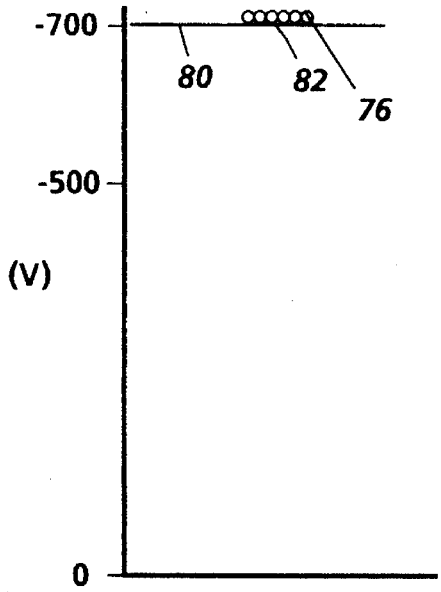
FIG. 2D shows the voltage profile of the image area with a toner layer after being recharged by by the first charging station.

After passing through the first development station E the image area advances so as to return to the first charging station B. The second cycle then begins. The first charging station B uses its first charging device 20 to overcharge the image area and its toner 76 (on section 82 of FIG. 2D) to more negative voltage levels than that which the image area and its first toner layer are to have when they are exposed. For example, as shown in FIG. 2D the image areas may be charged to a potential 80 of about –700 volts.

Figure 2E:
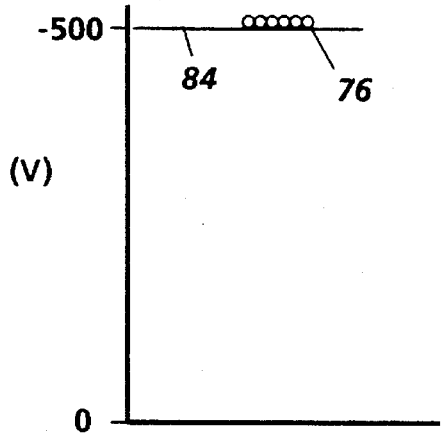
FIG. 2E shows the voltage profile of the image area with a toner layer after being recharged by the second charging station.

There the second charging device 22 reduces the negative charge on the image area by applying positive ions to the image area so as to level the charges between the toned and the untoned parts of the image area. As shown in FIG. 2E, after the image area passes the second charging device 22 both the untoned parts and the toned parts (represented by toner 76) of the image area are at a potential 84, say of about –500 volts. While the average potential of the toner layer after it passes through the second charging station has the potential 84, individual toner particles which comprise the toner layer will have potentials which vary widely. Since the second charging station supplies positive ions to the toner layer some of the toner particles are positively charged. Furthermore, toner particles near the exposed surface of the toner layer tend to be more positively charged than toner particles nearer to the photoreceptor.

An advantage of using an AC scorotron as the second charging device is that it has a high operating slope: a small voltage variation on the image area can result in large charging currents being applied to the image area. Beneficially, the voltage applied to the metallic grid of the second charging device 22 can be used to control the voltage at which charging currents are supplied to the image area. A disadvantage of using an AC scorotron is that it, like other AC operated charging devices, tends to generate more ozone than comparable DC operated charging devices.

Figure 2F:
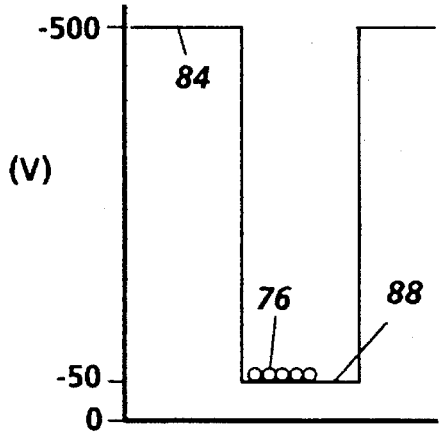
FIG. 2F shows the voltage profile of the image area after being reexposed.

After passing through the second charging station C the now substantially uniformly charged image area with its first toner layer advances to the exposure station D. At the exposure station D the recharged image area is again exposed to the output 24 of a laser based output scanning device 26. During this pass the scanning device 26 illuminates the image area with a light representation of a second color (say yellow) image. That light representation discharges some parts of the image area so as to create a second electrostatic latent image. For example, FIG. 2F illustrates the potentials on the image area after it passes through the exposure station D the second time. As shown, the non-illuminated areas have a potential about–500 as denoted by the level 84. However, the illuminated areas, both the previously toned areas denoted by the toner 76 and the untoned areas, denoted by the potential 88, are discharged to about –50 volts. It should be understood that while the average potential of the toner layer may be at the potential 88, individual toner particles in the toner layer will have potentials which vary widely. Some of those toner particles will have a positive charge.

After passing through the exposure station D the now exposed image area passes through a second development station F which deposits a second color of toner 32, yellow, onto the image area. To prevent disturbance of the previously developed first toner layer the second development station F should be a scavengeless developer.

After passing through the second development station F the image area and its two toner layers returns to the first charging station B. The third cycle begins. The first charging station B again uses its first charging device 20 to overcharge the image area and its two toner layers to more negative voltage levels than that which the image area and its two toner layer are to have when they are exposed. The second charging device 22 again reduces the image area potentials to an average potential 84 of about –500 volts. As before while the average potential of the toner layer may be at the potential 84 the individual toner particles in the toner layer will have potentials which vary widely. The substantially uniformly charged image area with its two toner layers then advances again to the exposure station D. At exposure station D the image area is again exposed to the output 24 of the laser based output scanning device 26. During this pass the scanning device 26 illuminates the image area with a light representation of a third color (say magenta) image. That light representation discharges some parts of the image area so as to create a third electrostatic latent image.

After passing through the exposure station D the third time the image area passes through a third development station G. The third development station G, preferably a scavengeless developer, advances a third color of toner 34, magenta, onto the image area. The result is a third toner layer on the image area.

The image area with its three toner layers then advances back to the charging station B. The fourth cycle begins. The first charging station B once again uses its first charging device 20 to overcharge the image area (and its three toner layers) to more negative voltage levels than that which the image area is to have when it is exposed (say about –500 volts). The second charging device 22 once again reduces the image area potentials to about–500 volts. The substantially uniformly charged image area with its three toner layers then advances yet again to the exposure station D. At the exposure station D the recharged image area is again exposed to the output 24 of the laser based output scanning device 26. During this pass the scanning device 26 illuminates the image area with a light representation of a fourth color (say cyan) image. That light representation discharges some parts of the image area so as to create a fourth electrostatic latent image.

After passing through the exposure station D the fourth time the image area passes through a fourth development station H. The fourth development station, also a scavengeless developer, advances a fourth color of toner 36, cyan, onto the image area. This marks the end of the fourth cycle.

After completing the fourth cycle the image area has four toner powder images which make up a composite color powder image. That composite color powder image is comprised of individual toner particles which have charge potentials which vary widely. Indeed, some of those particles have a positive charge. Transferring such a composite toner layer onto a substrate would result in a degraded final image. Therefore it becomes necessary to prepare the charges on the toner layer for transfer.

The fifth cycle begins by passing the image area through the erase station A. At erase station A the erase lamp 18 discharges the image area to a relatively low voltage level. This reduces the potentials of the image area, including that of the composite color powder image, to potentials near zero. The image area with its composite color powder image then passes to the charging station B. During the fifth cycle the charging station B performs a pretransfer charging function. The first charging device supplies sufficient negative ions to the image area that substantially all of the previously positively charged toner particles are reversed in polarity.

As the image area continues in its travel past the first charging station B a substrate 38 is advanced into place over the image area using a sheet feeder (which is not shown). As the image area and substrate continue their travel they pass through the charging station C. Importantly, positive charges, which because of the polarities used in the subsequently described transfer station are the most difficult to transfer, are also reduced to levels near zero.

At charging station C the second charging device 22 applies positive ions onto the exposed surface of the substrate 38. The positive ions attract the negatively charged toner particles on the image area to the substrate. As the substrate continues its travel the substrate passes a bias transfer roll 40 which assists in attracting the toner particles to the substrate and in separating the substrate with its composite color powder image from the photoreceptor belt 10. The substrate is then directed into a fuser station I where a heated fuser roll 42 and a pressure roller 44 create a nip through which the substrate passes. The combination of pressure and heat at the nip causes the composite color toner image to fuse into the substrate 38. After fusing, a chute, not shown, guides the support sheets 38 to a catch tray, also not shown, for removal by an operator.

After the substrate is separated from the photoreceptor belt 10 the image area continues its travel and eventually enters a cleaning station J. At cleaning station J a cleaning blade 48 is brought into contact with the image area. The cleaning blade wipes residual toner particles from the image area. The image area then passes once again to the erase station A and the 5 cycle printing process begins again.

The various machine functions described above are generally managed and regulated by a controller which provides electrical command signals for controlling the operations described above.

The 5 cycle printing architecture described above, particularly the embodiment illustrated in FIG. 1, has a number of advantages. The blade cleaner is not engaged except during the non-imaging 5th cycle. This simplifies the mechanical system required when registering four colors of toner. The paper path is very short. The printing system is relatively insensitive to dirt contamination since the dirt sensitive stations (the exposure station, the charging stations and the ) are all located above the dirt producing stations (the developing stations and the cleaning station). Furthermore, the 5 cycle printing architecture benefits from efficient multiple uses of various stations. For example, the charging station B is used for charging, for recharging, and for pretransfer charging. Likewise, the charging station C is used for charging, for recharging, and also for transfer. Additionally, the erase station is used for main erasing and for pretransfer erasing.

It is to be understood that while the figures and the above description illustrate the present invention, they are exemplary only. Others who are skilled in the applicable arts will recognize numerous modifications and adaptations of the illustrated embodiments which will remain within the principles of the present invention. Therefore, the present invention is to be limited only by the appended claims.

What is claimed is:

1. A method of operating an electrophotographic printing machine comprising the steps of:

(a) forming a toner layer on a photoreceptor;

(b) overcharging the photoreceptor and the toner layer with corona from a charging device to potentials higher than that which the photoreceptor and the toner layer are to have before they are exposed;

(c) reducing the potentials of the photoreceptor and the toner layer with corona from a subsequent charging station to the potential the photoreceptor and the toner layer are to have before they are exposed;

(d) forming a subsequent toner layer on the photoreceptor;

(e) charging the toner layer and the subsequent toner layer using corona from the charging device; and (f) transferring the toner layer and the subsequent toner layer onto a substrate using corona from the subsequent charging device.

2. An electrophotographic printing machine comprising a transfer charging device for charging a photoreceptor having a toner layer and a subsequent toner layer to a potential which the photoreceptor, the toner layer, and the subsequent toner layer are to have when they are exposed, said transfer charging device also for transferring the toner layer and the subsequent toner layer onto a substrate, said electrophotographic printing machine further including a pretransfer charging device for charging the photoreceptor, the toner layer, and the subsequent toner layer to potentials higher than that which they are to have when they are exposed, said pretransfer charging device also for charging the toner layer and the subsequent toner layer prior to transfer by said transfer charging station.

3. A method of operating an electrophotographic printing machine comprising the steps of:

(a) forming a toner layer on a photoreceptor;

(b) overcharging the photoreceptor and the toner layer with corona from a charging device to potentials higher than that which the photoreceptor and the toner layer are to have before they are exposed;

(c) reducing the potentials of the photoreceptor and the toner layer with corona from a subsequent charging station to the potential the photoreceptor and the toner layer are to have before they are exposed;

(d) forming a subsequent toner layer on the photoreceptor; and (e) transferring the toner layer and the subsequent toner layer onto a substrate using corona from the subsequent charging device.

* * * * *